United States Patent [19]

Goldfarb et al.

[11] 4,255,894

[45] Mar. 17, 1981

[54] EYE ASSEMBLIES FOR DOLLS

[75] Inventors: Adolph E. Goldfarb, 4614 Monarca, Tarzana, Calif. 91356; Erwin Benkoe, deceased, late of Encino, Calif., by Elisabeth Benkoe, executrix; Elonne Dantzer, Hermosa Beach, Calif.

[73] Assignees: Adolph E. Goldfarb, Tarzana, Calif.; Elisabeth Benkoe, Encino, Calif. ; executrix for the estate of Erwin Benkae

[21] Appl. No.: 864,251

[22] Filed: Dec. 27, 1977

[30] Foreign Application Priority Data

Dec. 29, 1976 [GB] United Kingdom ..... 54201/76

[51] Int. Cl.[2] ..... A63H 3/40

[52] U.S. Cl. ..... 46/169 A; 46/167

[58] Field of Search ..... 46/169 R, 169 A, 167, 46/135 R

[56] References Cited

U.S. PATENT DOCUMENTS

| | | | |
|---|---|---|---|
| 1,585,340 | 5/1926 | Fitzgerald | 46/169 R |
| 2,854,788 | 10/1958 | Baggott | 46/169 A |
| 3,462,876 | 8/1969 | Kirschenmann | 46/169 R |

FOREIGN PATENT DOCUMENTS

| | | | |
|---|---|---|---|
| 601768 | 2/1960 | Italy | 46/169 A |

*Primary Examiner*—Louis G. Mancene
*Assistant Examiner*—Mickey Yu
*Attorney, Agent, or Firm*—Robert M. Ashen; Robert J. Schaap

[57] ABSTRACT

A doll and an eye assembly, intended for use in a doll, wherein the assembly comprises a combined representational eyeball and eyelid movable mounted relative to a carrier or retainer, and weighted, in such a way as to tend to occupy a first positional relationship with the carrier or retainer (such as "open") in one attitude of the assembly to the horizontal but to occupy a second positional relationship with said carrier or retainer (such as "closed") in a different attitude of the assembly to the horizontal. The assembly also includes a fluid pressure actuable control operable to displace the combined eyeball and eyelid from said first "open" positional relationship to said second "closed" positional relationship. The assembly still further includes fluid pressure initiating mechanism such as an air bladder spaced from the combined eyeball and eyelid as in a hand of the doll and operatively associated with the control in such a way as to be selectively manually operable as by squeezing the hand to cause the control to effect such displacement when the assembly is in said one attitude to the horizontal. The doll may be operable to "blink" both eyes shut or to "wink" one eye shut.

2 Claims, 3 Drawing Figures

EYE ASSEMBLIES FOR DOLLS

This invention relates to eye assemblies for dolls and to dolls which incorporate such assemblies. The term "doll(s)" is to be interpreted in this specification as including not only representations of human figures but also representations of animals, mythical figures and the like.

Dolls (representing human figures) whose eyes are open when the doll concerned is generally upright, but whose eyes close, to simulate sleep, when the doll is laid on its back, are well known and some such dolls have been provided with means to eject water from their eye sockets to simulate crying. However, it is an object of the present invention to provide eye assemblies for dolls, and dolls which incorporate such assemblies, in which at least one additional "action" feature is incorporated.

According to the invention, there is provided an eye assembly, intended for use in a doll, wherein the assembly comprises a combined representational eyeball and eyelid movably mounted relative to a carrier or retainer, and weighted, in such a way as to tend to occupy a first positional relationship with the carrier or retainer in one attitude of the assembly to the horizontal but to occupy a second positional relationship with said carrier or retainer in a different attitude of the assembly to the horizontal, fluid pressure actuable means operable to displace the combined eyeball and eyelid from said first positional relationship to said second positional relationship, and fluid pressure initiating mechanism spaced from the combined eyeball and eyelid but connected thereto in such a way as to be usable to effect such displacement when the assembly is in said one attitude to the horizontal.

Preferably, as will become apparent below, the assembly comprises two eyeball and eyelid combinations and corresponding pneumatic or other fluid pressure actuating means that can be operated selectively by either of two separate initiating mechanisms to cause displacement of either only one, or both, of the two combinations. Thus, when a doll in which the assembly is incorporated is generally upright (said one attitude to the horizontal), the doll can be caused either to wink one of its eyes, or to blink both of them, by actuating the appropriate initiating mechanism, the two mechanisms being concealed in corresponding squeezable hands of the doll.

Figure 1:
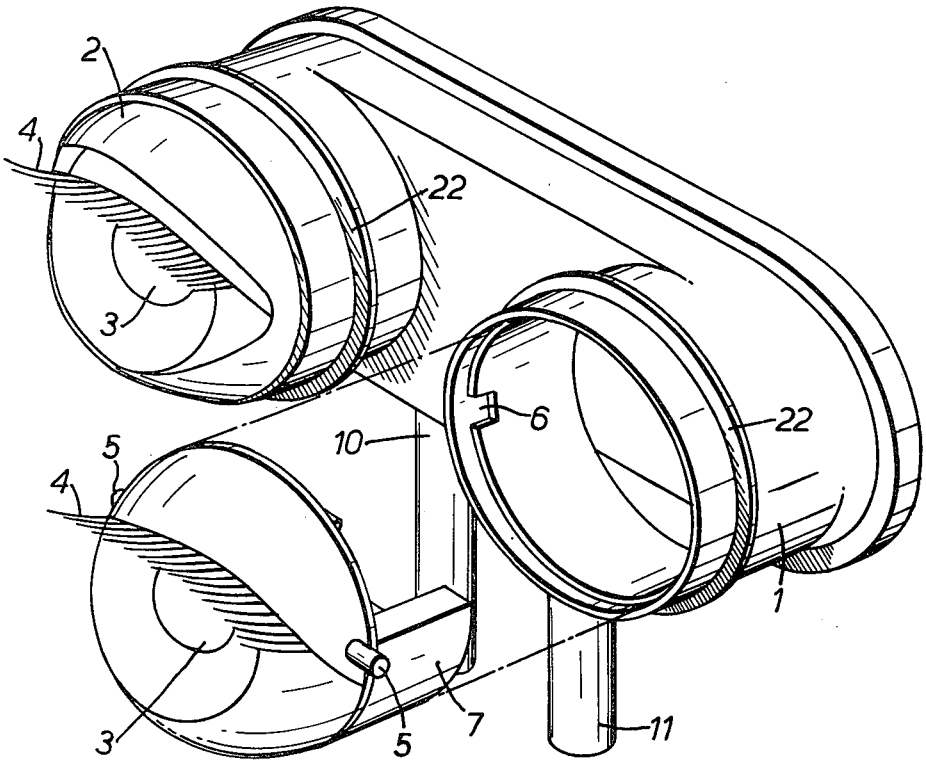
Figure 2:
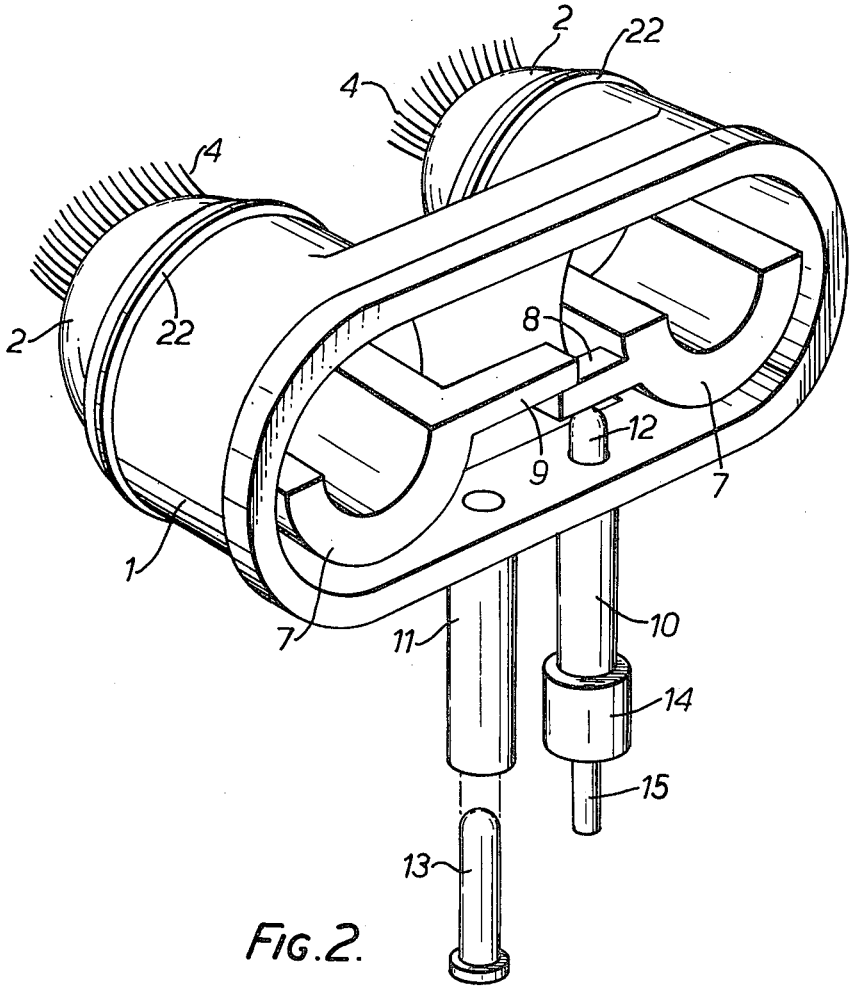
Figure 3:
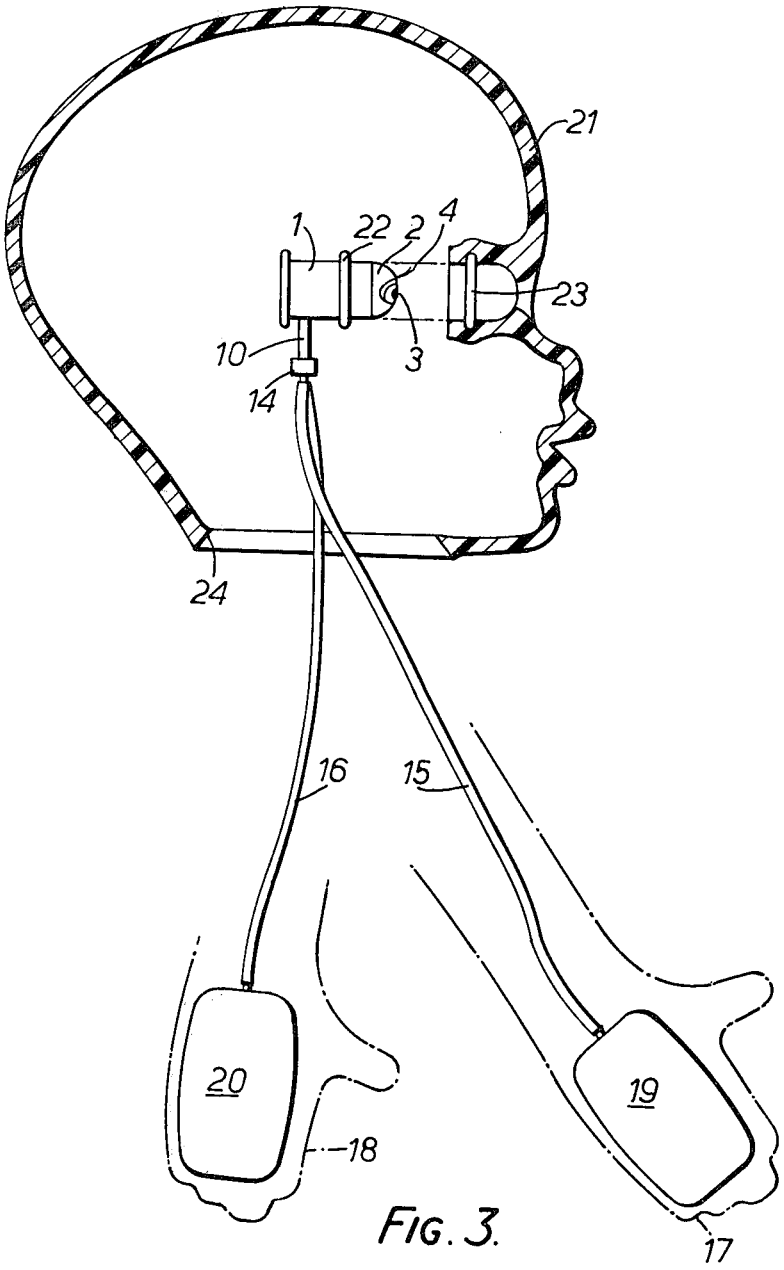

For a better understanding of the invention, and to show how the same may be carried into effect, reference will be made, by way of example, to the accompanying drawings, in which:

FIG. 1 is a front perspective view, with some components in a disassembled condition, of parts of a doll eye assembly in accordance with the invention, FIG. 2 is a rear perspective view of the assembly of FIG. 1 with other components thereof shown in a disassembled condition, and FIG. 3 is a somewhat diagrammatic elevation, to a reduced scale as compared with FIGS. 1 and 2, illustrating the incorporation of an assembly in accordance with the invention into a doll.

Referring to the accompanying drawings, the assembly that is illustrated therein comprises a housing that is generally indicated by the reference 1, the housing conveniently being moulded from a synthetic plastics material such as general purpose styrene. Two representational combined eyeballs and eyelids 3 are provided, the two combinations 3 each conveniently being moulded, in a conventional manner, from a transparent, or at least translucent, synthetic plastics material such, purely for example, as polymethyl methacrylate. As is again conventional, the combined eyeballs and eyelids 3 have non-toxic paints applied to them to give a pupil colour such as blue or brown, a white surround and a flesh-coloured region representing the eyelid. Lashes 4 that are secured in position by an adhesive or in any other convenient known manner project from curved lines on the two combinations 3 which coincide with the edges of the painted eyelid regions. Each combined representational eyeball and eyelid 3 is movably mounted in a corresponding carrier or retainer 2 which is conveniently moulded from the same synthetic plastics material as is the housing 1. Each combined eyeball and eyelid 3 is, in fact, pivotably mounted in the corresponding carrier or retainer 2 by axially aligned pins 5 which project from opposite sides of the combination 3 concerned and that are movably lodged in grooves 6 formed inside eye socket portions of the housing 1. The carriers or retainers 2 may be metal pressings suitably coloured by a layer of non-toxic paint or may be moulded from a synthetic plastics material which, again, is conveniently general purpose styrene.

The rear of each combined representational eyeball and eyelid 3 carries, inside the housing 1, a counterweight 7 and the arrangement, which is so far basically conventional, is such that, when the assembly or a doll in which the assembly is incorporated occupies a substantially upright attitude to the horizontal, the counterweights 7 keep the combined eyeballs and eyelids 3 in first relationships with the carriers or retainers 2 which are the "open" relationships that are shown in all three Figures of the accompanying drawings. The right-hand (in FIG. 2) counterweight 7 carries a lateral projection 8 and the left-hand (in the same Figure) counterweight 7 carries a lateral projection 9. The lateral projection 8 is of shorter length than the lateral projection 9 and is provided at a lower position on the corresponding counterweight 7 than is the projection 9 on its counterweight 7. In fact, as is clearly evident from FIG. 2 of the drawings, the arrangement is such that the free end of the upper left-hand projection 9 engages overlappingly above the free end of the right-hand lower projection 8. Two tubes 10 and 11 open at their upper ends into a lower wall of the housing 1 in register with the overlying projections 8 and 9 respectively. Each of the two tubes 10 and 11 receives a corresponding plunger 12 and 13, respectively, the plungers 12 and 13 being axially displaceable in the tubes 10 and 11, in the manner of co-operating free pistons and cylinders, but it should be noted that the plungers do not co-operate with the tubes in a closely fitting substantially leakproof manner but are deliberately arranged in such a way as to allow air to leak around them. Once again, the tubes 10 and 11 and the co-operating plungers 12 and 13 may be formed from a synthetic plastics material which is conveniently general purpose styrene. If desired, the rear of the housing 1 may be closed by a cover which is not, however, shown in the accompanying drawings.

When the assembly that is shown in FIGS. 1 and 2 of the drawings is incorporated into a doll in the manner shown in outline in FIG. 3, connectors 14 at the lowermost ends of the tubes 10 and 11 couple those tubes to the upper ends of flexible pipes 15 and 16 respectively, said flexible pipes 15 and 16 conveniently, but not essentially, being made from plasticised polyvinyl chloride. In addition to coupling the flexible pipes 15 and 16 to the tubes 10 and 11, the connectors 14 serve to prevent the plungers 12 and 13 from falling out of the lower ends of the tubes 10 and 11 and it will be noted that FIG. 2 of the drawings omits one of the two connectors 14 and shows the plunger 13 displaced axially downwards out of the tube 11 in order that the form of both of the plungers 12 and 13 may be illustrated.

The body of the doll into which the assembly is incorporated may be hollow and is conveniently formed from a yielding synthetic plastics material such as plasticised polyvinyl chloride. The arms and hands 17 and 18 are thus also hollow and each of the two hands 17 and 18 has a corresponding initiating mechanism in the form of a bladder 19 or 20 concealed in its interior. The bladders 19 and 20 have corresponding tubular openings which are sealingly connected to the ends of the corresponding flexible pipes 15 and 16 that are remote from the connectors 14. It is important that the material from which the bladders 19 and 20 are formed should be one that will readily allow deformation of the bladders under pressure but should be such that, when such pressure is withdrawn, said bladders will revert quite quickly to their original undeformed configurations. It has been found that the bladders 19 and 20 can be formed entirely satisfactorily by blow-moulding materials such as polyethylene or polypropylene.

When, as is common practice, the head 21 of a doll into which an assembly in accordance with the invention is to be incorporated is formed by rotation moulding from a resiliently deformable material such as plasticised polyvinyl chloride, the assembly may conveniently and advantageously be retained in its appointed position in said head 21 by forming annular flanges 22 on the external surfaces of the eye socket portions of the housing 1 and by rotation moulding the head 21 in such a way that matching annular recesses 23 are formed internally of the eye sockets in the plasticised polyvinyl chloride or other material from which the head 21 is principally made. FIG. 3 of the drawings shows the housing 1 of the eye assembly before its connection to the head 21 and it will be evident that, upon moving said housing 1 to the right as illustrated in FIG. 3, the flexibility of the eye sockets of said head 21 will allow the housing 1 to attain its appointed position in which position it will be maintained by co-operation of the flanges 22 with the annular recesses 23. Retention may be even more certainly maintained by additionally employing a compatible adhesive during installation of the housing 1 into the head 21.

The two flexible pipes 15 and 16 extend downwardly from the housing 1 through a neck opening 24 in the head 21 of the doll which neck opening 24, of course, co-operates in a known manner with a neck opening at the top of the initially separate body. It is common practice for the heads of dolls to be turnable relative to their bodies at the neck and, in the present case, if such turnability is to be provided between the head 21 and the body (not shown) of the doll, then it is desirable that co-operating stops should be furnished between the neck opening 24 and the opening at the top of the body whereby the turnability of the head 21 relative to the body will be limited to an angle of slightly less than 360° '. If a child were to be able to turn the head 21 through more than 360° in one direction relative to the body, such turning would badly twist, and probably eventually break, the flexible pipes 15 and 16.

When a doll incorporates an assembly in accordance with the invention as has been described with reference to FIG. 3 of the drawings, the doll will simulate a state of wakefulness when it occupies a generally upright attitude relative to the horizontal, its eyes appearing to be "open." When, on the other hand, the doll is laid down or is held more or less horizontally, the counterweight 7 will act to turn the combined eyeballs and eyelids 3 about the axes defined by the corresponding pins 5 in an anticlockwise direction as seen in FIG. 1 and 2 of the drawings and a clockwise direction as seen in FIG. 3, the doll then simulating a state of sleep in which its eyes appear to be closed. However, the assembly that is provided in accordance with the invention gives the doll two additional action features when the doll is disposed in a more or less upright attitude to the horizontal in which it simulates a state of wakefulness. Upon gripping and squeezing the hand 17, the bladder 19 will be compressed and the air pressure in that bladder and in the flexible pipe 15 will rise. This rise of pressure moves the plunger 12 upwardly in the tube 10 so that it comes into contact with the projection 8 which projection, in turn, contacts the projection 9. Both combined eyeballs and eyelids 3 will thus be caused to turn about the axes of the corresponding pairs of pins 5 so that both eyes will appear to close. If the compression affecting the bladder 19 is immediately withdrawn, said bladder will revert to its original configuration and the pressure therein and in the pipe 15 will drop causing the end of the plunger 12 that projects upwardly from the tube 10 to be withdrawn back into that tube. The gravity acting upon the counterweights 7 will then substantially immediately turn the two combinations 3 about the axes of the corresponding pins 5 into their original undisplaced positions. The doll will thus appear to have blinked. If the squeezing grip is maintained upon the doll hand 17, rather than being almost immediately released, the two combined eyeballs and eyelids 3 will remain in their positively displaced positions for a few seconds but the air that is compressed in the bladder 19 and the pipe 15 will leak from the tube 10 around the plunger 12 into the housing 1 thus allowing gravity to act upon the counterweights 7. The projection 8 will thus push the plunger 12 back into the tube 10 and both eyes will reopen, albeit somewhat more slowly than when a quick blink is produced by squeezing and substantially immediately releasing the hand 17.

Upon squeezing the hand 18, instead of the hand 17, the air pressure in the bladder 20 and pipe 16 is raised and the plunger 13 is moved upwardly in the tube 11 but, in this case, said plunger 13 co-operates only with the projection 9 and does not influence the projection 8. Accordingly, only the left-hand combined eyeball and eyelid 3 of the illustrated doll is pivoted about the axis of the corresponding pair of pins 5 so that said doll appears to close only its left eye and thus to wink if the compressing grip upon the hand 18 is quickly released. If the compressing grip upon the hand 18 is maintained, the left eye will remain closed for a few seconds but, as has been described above for the tube 10 and plunger 12, the air that is compressed inside the bladder 20 and pipe 16 will quite quickly leak away into the housing 1 past the plunger 13 after which the action of gravity upon the left-hand counterweight 7 will return the left-hand combination 3 to the position in which the eye appears to be open. It will, of course, be realised that the deliberate non-sealing relationship between the tubes 10 and 11 and the corresponding plungers 12 and 13 allows air to pass back around those plungers and down the pipes 15 and 16 to refill the bladders 19 and 20 at any times after those bladders have been squeezably deformed for at least several seconds.

It is to be noted that the invention is not limited only to what has been particularly described in connection with the accompanying drawings. More than one way of weighting combined eyeballs and eyelids is known and, in some methods of doing this, separate metal slugs or the like are attached, or metal tongues are provided for accurate adjustment of closing angles. Projections equivalent to the described and illustrated projections 8 and 9 can readily be provided in such cases for co-operation with plungers equivalent to the described and illustrated plungers 12 and 13. Although the described and illustrated blinking and winking combination is preferred, it would, of course, be possible to provide only one of two eyes in a doll with fluid pressure actuable means operable to displace the combined eyeball and eyelid of that eye from a first position to a second position in response to the action of a fluid pressure initiating mechanism concealed in one hand of the doll. In such a case, there could be a bladder or other fluid pressure initiating mechanism in each hand so that squeezably grasping either hand would cause only one eye to wink. A still further possible arrangement is to incorporate two such "single" assemblies in a doll in such a way that squeezably grasping one of its hands would cause one eye to wink and squeezably grasping the other hand would cause the other eye to wink. Both hands would have to be squeezed together to cause blinking with such an arrangement. Although the hands of dolls are the obvious places in which to provide bladders or other fluid pressure initiating mechanisms when the dolls in which the assemblies are to be used are dolls which simulate human babies or young children, it is noted that, particularly when the dolls are to represent animals or mythical figures, other sitings of the or each bladder or other fluid pressure initiating mechanism are equally possible at locations spaced from the eyes of the dolls concerned.

We claim:

1. An eye assembly, intended for use in a doll, wherein the assembly comprises a combined representational eyeball and eyelid movably mounted relative to a carrier, and weighted, in such a way as to tend to occupy a first positional relationship with the carrier in one attitude of the assembly to the horizontal but to occupy a second positional relationship with said carrier in a different attitude of the assembly to the horizontal, fluid pressure actuable means operable to displace the combined eyeball and eyelid from said first positional relationship to said second positional relationship, and fluid pressure initiating mechanism spaced from the combined eyeball and eyelid and operatively associated with said fluid pressure actuable means in such a way as to be selectively manually operable to cause said fluid pressure actuable means to effect such displacement when the assembly is in said one attitude to the horizontal, said assembly comprising two eyeball and eyelid combinations and corresponding fluid pressure actuating means that can be operated selectively by either of two separate initiating mechanisms to cause displacement of either only one, or both, of said two combinations, each of said eyeball and eyelid combinations comprising a projection, said projections being disposed in overlapping relationship, each fluid pressure actuating means being positioned to cooperate operatively with a correponding one of the projections whereby actuation of one of said means will cause displacement of only one of the two combinations whereas actuation of the other means will cause displacement of both combinations.

2. A doll comprising means representing a toy figure, means on said figure defining a carrier, and an eye assembly on said figure, said assembly comprising a combined representational eyeball and eyelid movably mounted on said carrier, and weighted, in such a way as to tend to occupy a first positional relationship with the carrier in one attitude of the assembly to the horizontal but to occupy a second positional relationship with said carrier in a different attitude of the assembly to the horizontal, fluid pressure actuable means operable to displace the combined eyeball and eyelid from said first positional relationship to said second positional relationship, and fluid pressure initiating mechanism spaced from the combined eyeball and eyelid and operatively associated with said fluid pressure actuable means in such a way as to be selectively manually operable to cause said fluid pressure actuable means to effect such displacement when the assembly is in said one attitude to the horizontal, said assembly comprising two eyeball and eyelid combinations and corresponding fluid pressure actuating means that can be operated selectively by either of two separate initiating mechanisms to cause displacement of either only one, or both, of said two combinations, each of said eyeball and eyelid combinations comprising a projection, said projections being disposed in overlapping relationship, each fluid pressure actuating means being positioned to cooperate operatively with a corresponding one of the projections whereby actuation of one of said means will cause displacement of only one of the two combinations whereas actuation of the other means will cause displacement of both combinations.

* * * * *